US009249968B2

(12) United States Patent
Hodrinsky et al.

(10) Patent No.: US 9,249,968 B2
(45) Date of Patent: Feb. 2, 2016

(54) HEAT-DISSIPATING LIGHT-EMITTING DEVICE AND METHOD FOR ITS ASSEMBLY

(71) Applicant: Liteideas, LLC, Mansfield Center, CT (US)

(72) Inventors: Todd W Hodrinsky, Mansfield Center, CT (US); Roger Whyte, Charlottesville, VA (US)

(73) Assignee: Liteideas, LLC, Mansfield Center, CT (US)

( * ) Notice: Subject to any disclaimer, the term of this patent is extended or adjusted under 35 U.S.C. 154(b) by 0 days.

(21) Appl. No.: 14/303,645

(22) Filed: Jun. 13, 2014

(65) Prior Publication Data

US 2015/0362169 A1 Dec. 17, 2015

(51) Int. Cl.

| | |
|---|---|
| ***F21V 29/00*** | (2015.01) |
| ***F21S 4/00*** | (2006.01) |
| ***F21V 29/74*** | (2015.01) |
| ***F21K 99/00*** | (2010.01) |
| ***F21V 23/00*** | (2015.01) |
| ***F21V 29/02*** | (2006.01) |

(52) U.S. Cl.

CPC . *F21V 29/74* (2015.01); *F21K 9/30* (2013.01); *F21K 9/90* (2013.01); *F21V 23/008* (2013.01); *F21V 29/00* (2013.01); *F21V 29/02* (2013.01); *F21V 29/2212* (2013.01)

(58) Field of Classification Search

CPC ..... F21V 29/006; F21V 29/76; F21V 29/763; F21V 29/70; F21V 29/83; F21V 29/74; F21V 23/009; F21V 19/001; F21V 29/02; F21V 29/2212; F21V 29/75; F21V 15/01; F21V 17/107; F21V 19/045; F21V 23/005

See application file for complete search history.

(56) References Cited

U.S. PATENT DOCUMENTS

| | | | | |
|---|---|---|---|---|
| 4,716,568 | A | 12/1987 | Scifres et al. | |
| 5,113,232 | A | 5/1992 | Itoh et al. | |
| 5,278,432 | A | 1/1994 | Ignatius et al. | |
| 5,479,029 | A | 12/1995 | Uchida et al. | |
| 6,335,548 | B1 | 1/2002 | Roberts et al. | |
| 6,428,189 | B1 | 8/2002 | Hochstein | |
| 7,075,112 | B2 | 7/2006 | Roberts et al. | |
| 8,405,289 | B2 * | 3/2013 | Chang | 313/46 |
| 8,414,152 | B2 | 4/2013 | Yen | |
| 8,430,533 | B1 * | 4/2013 | Blalock et al. | 362/294 |
| 8,446,081 | B2 | 5/2013 | Cheng | |
| 2011/0317437 | A1 * | 12/2011 | Chang | 362/373 |
| 2012/0268937 | A1 * | 10/2012 | Lee | 362/249.02 |
| 2013/0051009 | A1 * | 2/2013 | Zaderej et al. | 362/235 |
| 2013/0082600 | A1 | 4/2013 | Ter-Hovhanissian | |
| 2013/0208474 | A1 | 8/2013 | Chuang | |
| 2013/0271990 | A1 | 10/2013 | Hussell et al. | |

* cited by examiner

*Primary Examiner* — Vibol Tan

(74) *Attorney, Agent, or Firm* — Law Office Ilya Libenzon

(57) ABSTRACT

Disclosed is a heat-dissipating light-emitting device, including a light-emitting element, a heat-conducting base plate in physical contact with a heat sink, and a driver circuit. The driver circuit and light-emitting element are electrically coupled to each other and electrically isolated from the base plate. The light-emitting device and heat sink may be included in a light fixture. Also disclosed is a method for assembling the light-emitting device.

16 Claims, 6 Drawing Sheets

HEAT-DISSIPATING LIGHT-EMITTING DEVICE AND METHOD FOR ITS ASSEMBLY

TECHNICAL FIELD

The device and methods disclosed herein relate generally to light fixtures, and particularly to fixture assemblies designed to dissipate waste heat efficiently.

BACKGROUND ART

Recent years have seen a rapid development of brighter, more efficient electric light-emitting components. Devices like light-emitting diodes (LEDs) promise longer useful lives, greater reliability, better miniaturization, and greater energy efficiency than older electroluminescent technologies such as incandescent light bulbs. The greater energy efficiency means that for every lumen of light, the new electric light-emitting components waste less energy in the form of heat. Nonetheless, electric light-emitting components still generally produce some waste heat. Furthermore, many necessary elements in circuits that deliver electricity to electric light-emitting components inevitably generate waste heat as well. Waste heat can have a deleterious effect on the performance of electric light-emitting components. Long-term operation at higher temperatures decreases the useful lifespan of many electric light-emitting components, requiring more frequent replacements and decreasing their reliability. Moreover, some devices, such as LEDs, become less energy efficient as they heat up. This causes the devices either to dim, or to draw more current to produce the same output in lumens; moreover, if the devices draw more current to match their previous luminous output, they will necessarily produce greater quantities of waste heat, as will other elements in the circuit driving the light-emitting components. This results in further wear on the light-emitting components and circuit elements, and in a corresponding decrease in efficiency. The effects of waste heat can thus have a cascading effect, greatly increasing energy and replacement costs attendant to illumination.

Therefore, there remains a need for light-emitting devices that effectively dissipate heat from electric light-emitting components and associated circuitry.

SUMMARY OF THE EMBODIMENTS

Disclosed herein is a heat-dissipating light-emitting device. The device includes a light-emitting element having a light-emitting surface and a non-light-emitting surface. The device also includes a thermally conducting base plate having a first surface against which the light-emitting element is placed, a second surface, and a perimeter surface, the thermally conducting base plate electrically isolated from the light-emitting element, the thermally conducting base plate in physical contact with a heat sink. Also included in the device is a driver circuit element having a base surface in contact with the second surface of the base plate, and an opposite surface, the driver circuit element electrically coupled to the light-emitting element, the driver circuit electrically isolated from the base plate.

In a related embodiment, the base plate further includes at least one wing that contacts the heat sink. In another related embodiment, the base plate also includes a cavity in the first surface shaped to admit the base surface of light-emitting element. In an additional embodiment, the base plate also has a cavity in the second surface shaped to admit the base surface of the driver circuit element. In another embodiment, the heat sink additionally includes at least one heat-dissipating fin.

The heat sink also includes a housing having an open end, such that the light-emitting device fits snugly in the housing with the light-emitting surface facing the at least one open end, in another embodiment. In yet another embodiment, driver circuit element includes at least one rectifier. In another embodiment still, the driver circuit element is electrically coupled to the light-emitting element by a plurality of conducting clips that connect contact points in the light-emitting element to contact points in the driving circuit. According to another embodiment, the conducting clips are shaped to pass from the first surface of the base plate to the second surface of the base plate without touching the base plate.

Another embodiment of the device includes an electrically insulating holder, which has a first member that extends over a portion of the light-emitting surface of the light-emitting element, a second member that extends over a portion of the opposite surface of the driver circuit element, and a third member that connects the first member to the second member across the peripheral surface of the base plate. In a related embodiment, the holder includes a plurality of grooves, each groove containing one of the plurality of conducting clips, each groove running from a first end at an electrical contact on the light-emitting surface of the light-emitting element, across the first member of the holder, across the third member of the holder, across the second member of the holder, and to a second end at an electrical contact on the opposite surface of the driver circuit element. In another embodiment, the holder further includes a plurality of detachable sections. In another embodiment still, the holder also has at least one slot in the third portion of the holder, and wherein the base plate further comprises at least one wing that extends through the at least one slot and beyond the third portion of the holder. In a related embodiment, the heat sink also includes a housing having an interior surface, the housing further comprising at least one shelf on the interior surface, such that the at least one wing that extends through the at least one slot rests on the at least one shelf. The portion of the light-emitting surface covered by the first portion does not emit light, in another embodiment. In yet another embodiment, the device is attached to a light fixture adapted for insertion into a recess.

Also disclosed is a method for assembling a heat-dissipating, light-emitting device. The method involves providing a light-emitting element, a heat-conducting base plate, and a driver circuit element, as provided above, placing the non-light-emitting side of the light-emitting element in physical contact with the first side of the base plate, placing the base side of the driver circuit element in contact with the second side of the base plate, and electrically coupling the light-emitting element to the driver circuit element.

Other aspects, embodiments and features of the disclosed device and method will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation at its initial drawing depiction. For purposes of clarity, not every component is labeled in every figure. Nor is every component of each embodiment of the device and method is shown where illustration is not necessary to allow those of ordinary skill in the art to understand the device and method.

BRIEF DESCRIPTION OF THE DRAWINGS

The preceding summary, as well as the following detailed description of the disclosed device and method, will be better understood when read in conjunction with the attached drawings. It should be understood that the invention is not limited to the precise arrangements and instrumentalities shown.

FIG. 1D is a schematic diagram of one embodiment of a thermally conducting base plate;

FIG. 1E is a schematic diagram of circuitry in an embodiment of a driver circuit element;

DETAILED DESCRIPTION OF SPECIFIC EMBODIMENTS

Embodiments of the disclosed light-emitting device efficiently dissipate heat from electroluminescent components and from driving circuitry. Some embodiments increase the efficiency of heat dissipation by deploying the electroluminescent components and the driving circuitry on different surfaces of a heat-dissipation element. Isolation of the driving circuitry from the electroluminescent circuitry also prevents each set of circuitry from heating the other set in some embodiments. The configuration of some embodiments also allows the device to be disassembled, permitting separate replacement of components, and decreasing replacement costs.

Figure 1A:
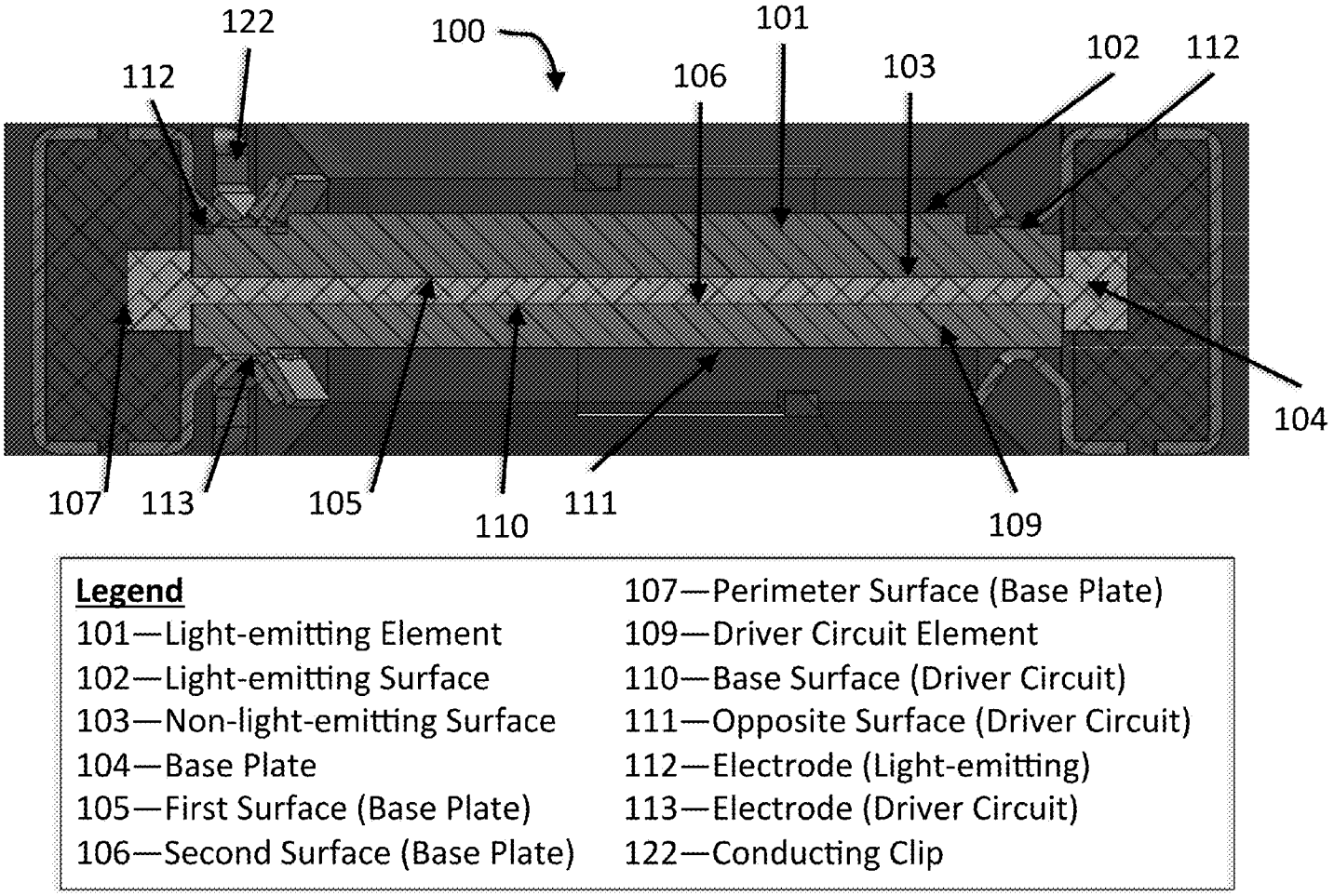
FIG. 1A is a schematic diagram illustrating a cross-sectional view of one embodiment of the disclosed light-emitting device.
Figure 1B:
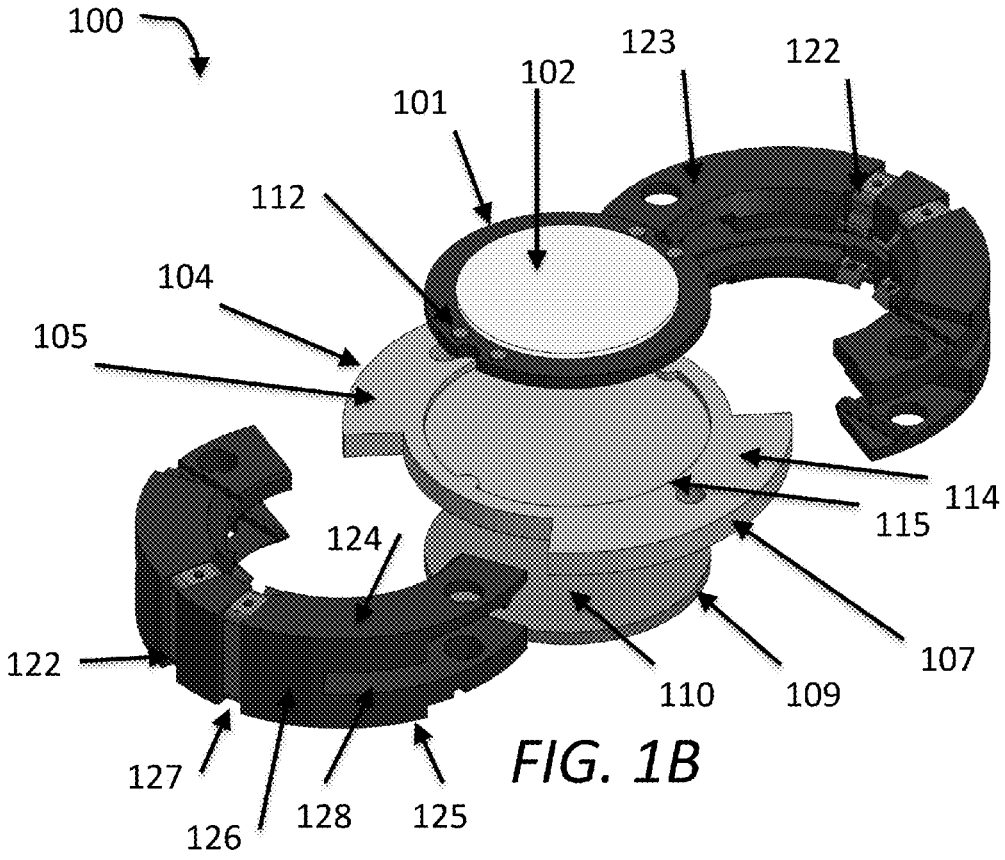
FIG. 1B is a schematic diagram illustrating an exploded view of one embodiment of the disclosed light-emitting device.
Figure 1C:
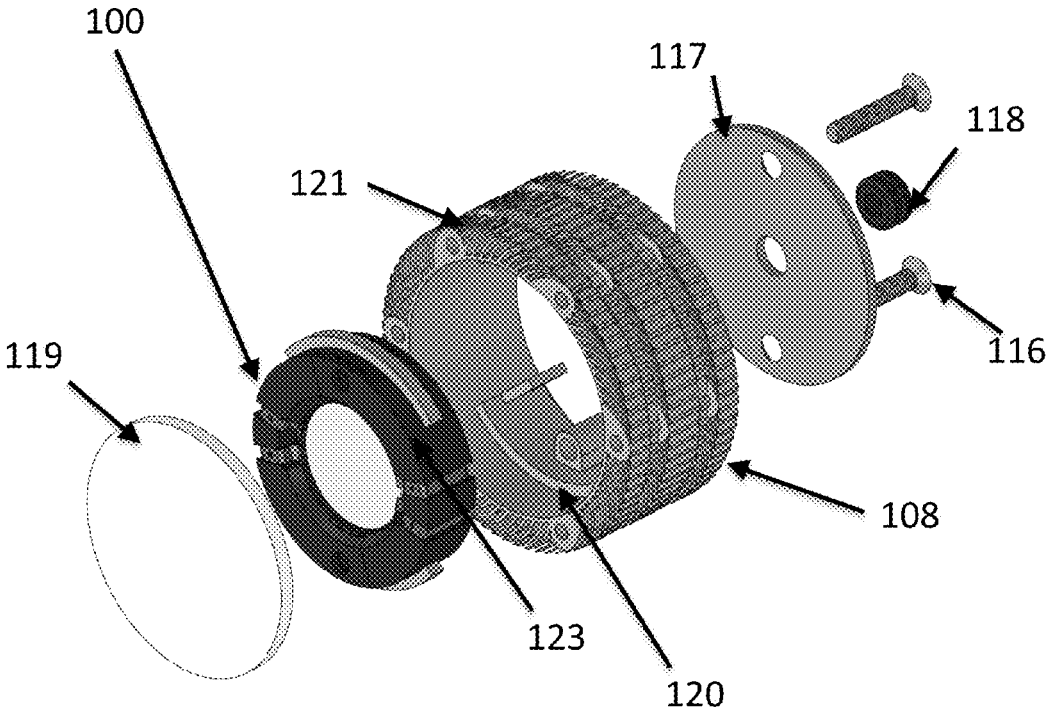
FIG. 1C is a schematic diagram of an embodiment the light-emitting device in combination with an embodiment of a heat sink.

FIGS. 1A-C illustrate embodiments of the disclosed heat-dissipating light-emitting device 100. FIG. 1A illustrates a cross-sectional view of one embodiment of the disclosed heat-dissipating light-emitting device 100. FIG. 1B illustrates an exploded view of the same embodiment. FIG. 1C shows one embodiment of the device 100 in an exploded view of one embodiment of a housing that contains the device 100. Briefly, the device 100 includes a light-emitting element 101 having a light-emitting surface 102 and a non-light-emitting surface 103. The device 100 also includes a thermally conducting base plate 104 having a first surface 105 against which the non-light-emitting surface 103 of the light-emitting element 101 is placed, a second surface 106, and a perimeter surface 107. The thermally conducting base plate 104 is electrically isolated from the light-emitting element 101. The thermally conducting base plate 104 is in physical contact with a heat sink 108, as illustrated in FIG. 1C. The device 100 also includes a driver circuit element 109 having a base surface 110 in contact with the second surface 106 of the base plate, and an opposite surface 111. The driver circuit element 109 is electrically coupled to the light-emitting element 101. The driver circuit element 109 is electrically isolated from the base plate 104.

Viewing FIGS. 1A-1C in greater detail, the device 100 includes a light-emitting element 101. In some embodiments, the light-emitting element 101 includes at least one electric light-emitting component, which converts electric energy into electromagnetic radiation. The electric light-emitting component may emit any form of electromagnetic radiation. The electric light-emitting component may emit visible light. In one embodiment, the electric light-emitting component is an electroluminescent device, which uses the electroluminescent effect to produce at least part of its light; for instance, the electric light-emitting component may be an LED. In another embodiment, the electric light-emitting component produces light via the incandescent effect, for instance by heating a filament until it glows, as in an incandescent light bulb. In another embodiment, the electric light-emitting component produces light by exciting a gas, as in a "neon" lamp. In yet another embodiment, the electric light-emitting component is a laser. In some embodiments, the electric light-emitting component employs the use of phosphors. Some embodiments of the electric light-emitting component emit light in part via fluorescent materials; for example, the electric light-emitting component may produce ultraviolet light by exciting a gas, and convert it to visible light using a fluorescent material that absorbs ultraviolet light and emits visible light. As another example, the electric light-emitting component may use the electroluminescent effect to produce visible light in one or more wavelengths while a fluorescent material in the electric light-emitting component absorbs light in those wavelengths and releases light in another set of wavelengths. Some embodiments of the electric light-emitting component may emit light in part via phosphorescent materials, which absorb energy and release it gradually as light; for instance, the electric light-emitting component may release light in short pulses, which is absorbed and re-emitted more gradually by phosphorescent material, producing a smoother light output. A remote phosphor may be placed between the electric light-emitting component and the area to be illuminated, for instance where a lens 119 might be placed as shown in FIG. 1C and described in further detail below. The remote phosphor may convert the light from a set of point sources, such as blue LED chips, into a more uniformly distributed source of illumination. The remote phosphor may emit light in a different color from the LED chips, or in a broader or narrower spectrum of colors. The light-emitting component may include one or more solar collectors, which transmit natural sunlight into light fixtures, for instance, using fiber-optic cables linked to light-collecting lens arrays. The light-emitting component may include one or more organic light-emitting diodes (OLED).

The at least one electric light-emitting component is electrically connected to the driver circuit element 109. In some embodiments, the at least one electric light-emitting component is electrically connected to one or more electrodes 112 that are connected electrically to the driver circuit element 109 as described in greater detail below. The light-emitting element 101 may have a plurality of electric light-emitting components. In some embodiments, the plurality of electric light emitting devices are connected together in a common circuit; for instance, a grid of LEDs connected by conductors. The circuitry within the light-emitting element 101 may include at least one printed circuit board. The light-emitting element 101 may include a lens that covers the electric light-emitting components. The lens in some embodiments is formed to focus the light emitting from within the fixture. In some embodiments, the lens is formed to diffuse the light emitting from within the fixture. The lens is transparent in some embodiments. In some embodiments, the lens is translucent; for instance the lens may act to soften the emitted light by passing it through a translucent white material. The lens may be constructed from any transparent material. The lens may be constructed from any translucent material. The lens may be constructed from glass. The lens may be constructed from clear plastic. The lens may be constructed from translucent plastic. The lens may be constructed from transparent polycarbonate. The lens may be constructed from translucent polycarbonate. The lens may be constructed from transparent polyethylene. The lens may be constructed from translucent polyethylene. The lens may be constructed from acrylic glass. The lens may be constructed from crystal. The lens may be constructed from a transparent ceramic. The lens may be constructed from a translucent ceramic. The lens may be constructed from a transparent metal. The lens may be constructed from a translucent metal. The lens may be constructed from any combination of translucent materials. The lens may be constructed from any combination of transparent materials.

The portion of the light-emitting element 101 comprising electrical circuitry may be constructed from any electrically conducting materials. The electrical circuitry may be constructed from metal. The electric circuitry may be created by manufacturing techniques to produce printed circuit boards, including etching a conducting material laminated on a non-conducting surface to produce the desired circuit. In some embodiments, the circuitry and electric light-emitting components are fixed on a substrate. The substrate may be constructed from any suitable materials or combination of materials. The materials may have heat transfer properties; for instance, the materials may include thermal pastes or thermal transfer epoxy bonding agents. A portion of the substrate may be electrically insulating. In some embodiments, the entire substrate is electrically insulating. In other embodiments, the part of the substrate in immediate contact with circuitry is electrically insulating. In still other embodiments, the part of the substrate in immediate contact with the base plate 104 is electrically insulating. In some embodiments, the substrate is composed of electrically conducting material coated by a dielectric material. Parts of the substrate may be composed of thermally conducting material. In some embodiments, the entire substrate is thermally conducting; for instance, the substrate may be composed of a thermally conducting but electrically insulating ceramic. In other embodiments, the substrate contains thermally conducting elements that are in close proximity with the electric light-emitting components. The thermally conducting elements may be in close proximity with the base plate 104. As an example, at least one thermally conducting portion of the substrate may run from at least one electric light-emitting component to the base plate 104; the thermally conducting portion may be divided from either the electric light-emitting component or from the base plate 104 by dielectric material.

In some embodiments, the light-emitting element 101 is substantially flat. The light-emitting element 101 may be substantially polygonal; for instance, the light-emitting element may be square in cross-section. The light-emitting element 101 may have a substantially regular polygonal cross-section. The cross section of the light-emitting element 101 may be substantially an irregular polygon; for instance, the cross section of the light-emitting element 101 may be rectangular. The cross-section of the light-emitting element 101 may be trapezoidal. The cross-section of the light-emitting element 101 may be substantially a combination of polygons. As an example, the cross-section or the light-emitting element 101 may be describable in as a combination of variously sized and formed triangles. The cross-section of the light-emitting element 101 may be curved. The cross-section may be elliptical. The cross-section may be circular. The cross section may be a more complex curved form, such as a bent or irregular ellipse. The cross section may be any combination of curved and polygonal forms; for instance, the cross-section may be rectangular with rounded corners. The cross-section may be a parabola truncated by at least one straight line. The light-emitting element 101 may have indentations in its perimeter; for example, the light-emitting element 101 may have an indentation formed to fit a projection within a cavity in the base plate, as described in more detail below.

The light-emitting side 102 of the light-emitting element 101 may have a light-emitting portion and a non-light-emitting portion. In some embodiments, the light-emitting portion covers a geometric form covering at least the geometric center of the horizontal cross-section of the light-emitting side 102. In some embodiments, the geometric form is substantially proportional to the form of the horizontal cross section of the light-emitting side 102. As an example, where the horizontal cross section of the light-emitting side 102 is substantially circular, the geometric form of the light-emitting portion may also be substantially circular; the geometric form may be concentric with the horizontal cross section, causing the non-light-emitting portion to be a substantially annular region bounding the light-emitting portion. The geometric form may be cotangential with the horizontal cross section at one point. The geometric form may be positioned anywhere within the horizontal cross section. As another example, where the horizontal cross-section is substantially polygonal, the geometric from may be a similar polygonal form. The geometric form may be in a different alignment from the horizontal cross-section. The geometric form may be a different shape from the horizontal cross-section. The geometric form may be shaped or arranged in triangular, rectangular, hexagonal, square or linear fashion.

In some embodiments, the light-emitting element 101 has at least one electrode 112. In some embodiments, the at least one electrode 112 is a plurality of electrodes. The at least one electrode 112 may be on the light-emitting side 102 of the light-emitting element 101. The at least one electrode 112 may be on the non-light-emitting portion of the light-emitting side 102 of the light-emitting element 101. The at least one electrode 112 may be on the non-light-emitting side of the light-emitting element 101. The at least one electrode 112 may be on an additional surface of the light-emitting element 101; for instance, the at least one electrode 112 may be on a peripheral surface of the light-emitting element 101.

The non-light-emitting surface 103 of the light-emitting element 101 is in physical contact with the first surface 105 of the base plate 104. In some embodiments, the light-emitting element 101 and base plate 104 are joined by adhesive. In some embodiments, the light-emitting element 101 and base plate 104 are joined by fasteners; for instance, the light-emitting element 101 and base plate 104 may be joined by screws. The light-emitting element 101 and base plate 104 may be joined by brads. The light-emitting element 101 and base plate 104 may be joined by bolts. The light-emitting element 101 and base plate 104 may be joined by tab- and slot combinations. The light-emitting element 101 and base plate 104 may be joined by soldering. The light-emitting element 101 and base plate 104 may be joined by molding. The light-emitting element 101 and base plate 104 may be joined by a holder, as set forth in more detail below.

The light-emitting device 100 also includes a thermally conducting base plate 104 that is in physical contact with a heat sink 108. The thermally conducting base plate may be constructed of any combination of materials that presents a thermally conductive path from the light-emitting element 101 and the driver circuit element 109 to the heat sink 108. The base plate 104 may be constructed of a single thermally conducting material. The base plate 104 may be constructed of a combination of thermally conducting materials. The base plate 104 may be constructed of a combination of thermally conducting materials with materials that are not thermally conducting. The base plate 104 may be constructed of electrically conductive materials. In some embodiments, the base plate 104 is composed at least partly of metal. The metal may be aluminum. In some embodiments, the base plate 104 is composed of an electrically conductive polymer material. In some embodiments, the base plate 104 is composed of an electrically conductive ceramic. The base plate 104 may be composed of electrically insulating materials; for instance, the base plate 104 may be composed of a thermally conductive but electrically insulating ceramic. The base plate 104 may be composed of a thermally conductive but electrically insulating plastic or other polymer. The base plate 104 may be composed of a combination of electrically conducting and electrically insulating materials. As an example, the base plate 104 may be composed of a metal with a dielectric coating to insulate it from the circuitry in the light-emitting element 101 and the driver circuit element 109.

In some embodiments, the base plate 104 is substantially flat. The base plate 104 may be substantially polygonal; for instance, the light-emitting element may be square in cross-section. The base plate 104 may have a substantially regular polygonal cross-section. The cross section of the base plate 104 may be substantially an irregular polygon; for instance, the cross section of the base plate 104 may be rectangular. The cross-section of the base plate 104 may be trapezoidal. The cross-section of the base plate 104 may be substantially a combination of polygons. As an example, the cross-section or the base plate 104 may be describable in as a combination of variously sized and formed triangles. The cross-section of the base plate 104 may be curved. The cross-section may be elliptical. The cross-section may be circular. The cross section may be a more complex curved form, such as a bent or irregular ellipse. The cross section may be any combination of curved and polygonal forms; for instance, the cross-section may be rectangular with rounded corners. The cross-section may be a parabola truncated by at least one straight line.

In some embodiments, as shown in FIG. 1D, the base plate has at least one wing 114 that contacts the heat sink 108 (for instance as illustrated in FIG. 1C). The at least one wing 114 may have any shape necessary to contact a corresponding surface on the heat sink 108. As an example, in some embodiments where the base plate 104 is substantially circular, each wing 114 extends beyond the circumference of the substantially circular base plate, such that the end of the wing 114 forms an arc of a larger substantially circular form substantially concentric with the base plate 104. In some embodiments, the at least one wing 114 is two wings 114 that extend from a substantially circular base plate 104 such that the ends of the wings 114 form two one hundred degree arcs of a larger substantially circular form substantially concentric with the substantially circular form of the base plate 104. Each wing 114 may be a portion of any curved geometric form. Each wing 114 may be a portion of any polygonal geometric form.

In some embodiments of the device, the base plate 104 also includes at least one cavity 115 formed to admit the light-emitting element 101 or the circuit driver element 109. The geometric form of the horizontal cross-section of the cavity 115 may be any geometric form suitable for the horizontal cross-section of the light-emitting element 101, as described above in reference to FIGS. 1A-1C. In some embodiments, the cavity 115 is a cavity in the first surface 105 shaped to admit the non-light-emitting surface 103 of the light-emitting element 101. The cavity may be an indentation substantially the same shape as the non-light-emitting side 103 of the light-emitting element 101. The indentation may fit snugly around the light-emitting element 101. In some embodiments, there are one or more projections 116 into the indentation 115. The projections 116 may be so formed as to fit indentations in the light-emitting element 101, as described above in reference to FIGS. 1A-1C. The cavity 115 may be formed to admit the driver circuit element 109. The geometric form of the horizontal cross-section of the cavity 115 may be any geometric form suitable for the horizontal cross-section of the driver circuit element 109, as described above in reference to FIGS. 1A-1C. In some embodiments, the cavity 115 is a cavity in the second surface 105 shaped to admit the base surface 110 of driver circuit element 109. The cavity may be an indentation substantially the same shape as the base side 109 of the driver circuit element 109. The indentation may fit snugly around the driver circuit element 109. In some embodiments, there are one or more projections 116 into the indentation 115. The projections 116 may be so formed as to fit indentations in the driver circuit element 109.

In some embodiments, the base plate connects to a heat sink 108. In one embodiment, the heat sink 108 is a structure that absorbs heat from the base plate 104. The heat sink 108 may be composed of any combination of heat-conducting materials. In some embodiments, the heat sink 108 is composed at least in part of metal. In some embodiments, the heat sink 108 has a large mass, relative to the light-emitting element 100, to increase its capacity to absorb heat. The heat sink 108 may form a housing into which the light-emitting element 100 fits. In some embodiments, the heat sink 108 makes up a housing having an open end, such that the light-emitting device fits snugly in the housing with the light-emitting surface facing the at least one open end. The housing may have a cross-sectional form that matches the cross-sectional perimeter of the lighting element 100. Where the light-emitting element is so formed that it fits snugly within a space having a cross-section of a particular geometric form, the housing may have a cross-section substantially matching that geometric form. As an example, where the base plate 104 is substantially circular and each wing 114 extends beyond the circumference of the substantially circular base plate, such that the end of the wing 114 forms an arc of a larger substantially circular form substantially concentric with the base plate 104, the cross-section of the interior of the housing may be substantially a circle with a circumference sized to admit that larger substantially circular form snugly. In a related example, the cross section of the interior of the housing may be a geometric form substantially matching the perimeter of the light-emitting device 100, including the wings 114. The housing may be connected to the light-emitting element 100 using fasteners. For instance, the housing and the light-emitting device 100 may each have holes to admit screws 116, rivets, or bolts, which fasten the housing to the light-emitting device 100. The fasteners may be clips. The housing and light-emitting device 100 may be formed to fit together securely without fasteners; for instance, the light-emitting device 100 and housing may have tabs and slots that join to hold the two elements together. The housing may be threaded to admit the light-emitting device 100. The light-emitting device 100 may also be threaded.

In some embodiments, the housing has a removable back 117. The back 117 may be attached to the housing using screws 116. In some embodiments, the screws 116 attaching the back plate 117 to the housing are the same screws 116 that secure the light-emitting device 100 in the housing. The back 117 may have a grommet 118. A power cable (not shown) may be inserted though the grommet 118. In some embodiments, the housing has a lens 119 that covers the open end of the housing toward which the light-emitting side 102 of the light-emitting element 101 faces. The lens may be composed of any material or set of materials suitable for the composition of a lens as discussed above in reference to FIGS. 1A-1C.

The heat sink 108 may be shaped so as to contact the base plate 104 over a substantial surface area. Where the base plate 104 has at least one wing 114 as described above in reference to FIG. 1D, the heat sink 104 may be formed to contact a portion of the surface area of the at least one wing 114. For instance, the heat sink 108 may include at least one slot (not shown) into which the at least one wing may be inserted. The heat sink 108 may include a shelf 120 on which the at least one wing rests when the light-emitting device 100 and the heat sink are combined; for example, where the heat sink 108 is a housing having an interior surface, the housing may include at least one shelf 120 on the interior surface, such that the at least one wing 114 rests on the at least one shelf 120. In another embodiment, the heat sink 108 includes one or more heat pipes (not shown) that are embedded in the base plate 104; for instance, the one or more heat pipes may be embedded in the at least one wing 114.

The heat sink 108 may include features to enhance dissipation of heat from the heat sink. The heat sink 108 may include at least one heat-dissipating fin 121. The heat sink 108 may include a plurality of heat-dissipating fins 121. In some embodiments, the heat sink 108 includes a component (not shown) that dissipates heat via convection. The component may function via air convection. The component may include one or more passages in the heat sink 108 that permit airflow, enhancing convection. The air passages may be formed so that the convection of air heated by the heat sink causes hot air to leave the heat sink while drawing in cool air. The component may include a mechanical element for increasing airflow; for instance, the component may include a fan. The component may function using fluid convection. The component may include a fluid reservoir. The component may include one or more passages in the heat sink 108 that permit fluid to flow through the heat sink 108, enhancing convection. The passages may be formed so that the convection of fluid heated by the heat sink causes more rapid fluid flow, increasing heat transfer rates. The component may include a mechanical element for increasing fluid flow; for instance, the component may include a pump.

The light-emitting device 100 includes a driver circuit element 109. FIG. 2E illustrates a schematic drawing of the circuitry in one embodiment of the driver circuit element 109. In some embodiments, the driver circuit element 109 is an element that connects the light-emitting element 101 to a power source 129, and contains a circuit element that regulates the electrical power to the light-emitting element 101. The circuit element may include a supplementary power source (not shown). The circuit element may include an amplifier (not shown). The circuit element may include a current-limiting element; for instance, the circuit element may include one or more resistors 130. The circuit element may include one or more inductors (not shown). The circuit element may include one or more capacitors (not shown). The circuit element may include one or more transistors (not shown). The circuit element may include one or more diodes. In some embodiments, the driving circuit element 109 includes at least one rectifier 131. The rectifier may be full-wave rectifier. The rectifier may be a half-wave rectifier. The circuit element may be a transformer (not shown). The circuit element may include a microprocessor (not shown) that regulates the power to the light-emitting element 101 using additional circuit elements. The circuit may connect to the light-emitting element via leads 132. The leads 133 may connect to the light-emitting element 101 by way of the electrodes 112. In some embodiments, the driver circuit element 109 includes a plurality of driver circuits, each connected to a different light-emitting circuit on the light-emitting element 101. For instance, one embodiment of the driver circuit element 109 has a total of 12 input points and 8 AC rectifiers.

The driver circuit element 109 may include a printed circuit board. The portion of the driver circuit element 109 comprising electrical circuitry may be constructed from any electrically conducting materials. The electrical circuitry may be constructed from metal. The electric circuitry may be created by manufacturing techniques to produce printed circuit boards, including etching a conducting material laminated on a non-conducting surface to produce the desired circuit. In some embodiments, the circuitry and circuit elements are fixed on a substrate. The substrate may be constructed from any suitable materials or combination of materials. A portion of the substrate may be electrically insulating. In some embodiments, the entire substrate is electrically insulating. In other embodiments, the part of the substrate in immediate contact with circuitry is electrically insulating. In still other embodiments, the part of the substrate in immediate contact with the base plate 104 is electrically insulating. In some embodiments, the substrate is composed of electrically conducting material coated by a dielectric material. Parts of the substrate may be composed of thermally conducting material. In some embodiments, the entire substrate is thermally conducting; for instance, the substrate may be composed of a thermally conducting but electrically insulating ceramic. In other embodiments, the substrate contains thermally conducting elements that are in close proximity with the circuit element. The thermally conducting elements may be in close proximity with the base plate 104. As an example, at least one thermally conducting portion of the substrate may run from at least one circuit element to the base plate 104; the thermally conducting portion may be divided from either the circuit element or from the base plate 104 by dielectric material.

In some embodiments, the driver circuit element 109 is substantially flat. The driver circuit element 109 may be substantially polygonal; for instance, the driver circuit element may be square in cross-section. The driver circuit element 109 may have a substantially regular polygonal cross-section. The cross section of the driver circuit element 109 may be substantially an irregular polygon; for instance, the cross section of the driver circuit element 109 may be rectangular. The cross-section of the driver circuit element 109 may be trapezoidal. The cross-section of the driver circuit element 109 may be substantially a combination of polygons. As an example, the cross-section or the driver circuit element 109 may be describable in as a combination of variously sized and formed triangles. The cross-section of the driver circuit element 109 may be curved. The cross-section may be elliptical. The cross-section may be circular. The cross section may be a more complex curved form, such as a bent or irregular ellipse. The cross section may be any combination of curved and polygonal forms; for instance, the cross-section may be rectangular with rounded corners. The cross-section may be a parabola truncated by at least one straight line. The driver circuit element 109 may have indentations in its perimeter; for example, the driver circuit element 109 may have an indentation formed to fit a projection within a cavity in the base plate, as described in more detail below.

In some embodiments, the driver circuit element 109 has at least one electrode 113. In some embodiments, the at least one electrode 113 is a plurality of electrodes. The at least one electrode 113 may be on the base side 110 of the driver circuit element 109. The at least one electrode 113 may be on the opposite side 111 of the driver circuit element 109. The at least one electrode 113 may be on an additional surface of the driver circuit element 109; for instance, the at least one electrode 113 may be on a peripheral surface of the driver circuit element 109. The driver circuit element 109 is electrically coupled to the light-emitting element 109. In one embodiment, the driver circuit element 109 and the light-emitting element 101 are electrically coupled if the circuitry in the driver circuit element 109 and the circuitry in the light-emitting element 101 are joined to form a single electric circuit. In another embodiment, the driver circuit element 109 is electrically coupled to the light-emitting element 101 by at least one piece of conducting material; for instance, the at least one piece of conducting material may connect at least one electrode on the driver circuit element 109. The at least one piece of conducting material may be electrically isolated from the base plate 104. The at least one piece of conducting material may be insulated. The at least one piece of conducting material may be formed so that when electrically coupling the driver circuit element 109 to the light-emitting element 101 the at least one piece of conducting material does not contact the base plate 104. In some embodiments, at least one wire couples the light-emitting element 101 to the driver circuit element 109. In other embodiments, the driver circuit element 109 is electrically coupled to the light-emitting element 101 by a plurality of conducting clips 122 that connect contact points in the light-emitting element 101 to contact points in the driver circuit element 109; for instance, the conducting clips 122 may connect a plurality of electrodes 112 on the light-emitting element 101 to a plurality of electrodes 113 on the driver circuit element 109. In some embodiments, the conducting clips 122 are shaped to pass from the light-emitting element 101 to the driver circuit element 109 without touching the base plate 104. As an example, the clips 122 may be substantially C-shaped, such that when a clip 122 is touching an electrode on the light-emitting side of the light-emitting element 101 and touching an electrode on the opposite side 111 of the driver circuit element 109, the remainder of the conducting clip 122 passes around the base plate 104, thus maintaining electrical isolation from the base plate 104. The clips 122 may have elastic properties, so that, for instance, a C-shaped clip 122 exerts a spring recoil force inwards, causing it to grip the electrodes 112, 113 on the light-emitting element 101 and the driver circuit element 109 and hold itself in place; the plurality of clips 122 may hold the light-emitting element 101, the base plate 104, and the driver circuit element 109 together.

The base surface 111 of the driver circuit 109 is in physical contact with the second surface 106 of the base plate 104. In some embodiments, the base plate 104 and the driver circuit 109 are joined by one of the methods described above for joining the base plate 104 and the light-emitting element 101 in reference to FIGS. 1A-1C. In some embodiments, the plurality of conducting clips 122 holds together the driver circuit element 109, base plate 104, and light-emitting element 101. Where the base plate 104 has at least one cavity 115, as described above in reference to FIG. 1D, the at least one cavity 115 may help hold together the light-emitting element 101, base plate 104, and driver circuit element 109; for instance, where the cavity 115 snugly fits the driver circuit element 109, the tight fit between the driver circuit element 109 and the cavity 115 may be sufficient to hold the driver circuit element 109 in the cavity, and thus in contact with the base plate 104. A cavity 115 fit snugly to the light-emitting element 109 may similarly hold the light-emitting element 109 in place. The plurality of conducting clips may be soldered into place after the assembly is joined together into a single unit.

In other embodiments, the base plate 104, driver circuit 109, and light-emitting element 101 are joined by an electrically insulating holder 123. The electrically insulating holder 123 may be composed of any electrically insulating material or combination of materials suitable for the composition of a substrate, as described above in reference to FIGS. 1A-1C. The holder 123 may also be constructed from hard rubber. In one embodiment, a combination of materials making up the holder 123 is electrically insulating if the holder 123 creates no conductive path connecting any of the base plate 104, the light-emitting element 101, the driver circuit element 109, or any component electrically coupling the light-emitting element 101 to the driver circuit element 109 to each other. In some embodiments, the electrically insulating holder 123 has a first member 124 that extends over a portion of the light-emitting surface 102 of the light-emitting element 101, a second member 125 that extends over a portion of the opposite surface 111 of the driver circuit element 109, and a third member 126 that connects the first member 124 to the second member 125 across the peripheral surface 107 of the base plate 104. The holder 123 may be molded around the light-emitting element 101, base plate 104, and driver circuit element 109. In other embodiments, the holder 123 is formed by fixing together a plurality of sections. The sections may be joined using adhesive. The sections may be fused together. The sections may be joined using fasteners, such as screws or rivets. In some embodiments, the holder 123 is made up of a plurality of detachable sections. The sections may be detachable if they may be disassembled and reassembled an indefinite number of times without damaging them. In some embodiments, the sections making up the holder 123 have a mechanical locking mechanism to secure the LED module and AC rectifier circuit board into an electrically connected subassembly. In some embodiments, disassembling the detachable sections allows a user to separate the light-emitting element 101, base plate 104, and driver circuit element 109 from each other. As a result, it may be possible to replace the light-emitting element 101, base plate 104, or driver circuit element 109 separately, if one of the three has worn out.

In some embodiments, the holder 123 also includes a plurality of grooves 127, each groove containing one of the plurality of conducting clips 122, each groove 127 running from a first end at an electrical contact 112 on the light-emitting surface 102 of the light-emitting element 101, across the first member 124 of the holder, across the third member 126 of the holder, across the second member 125 of the holder, and to a second end at an electrical contact 113 on the opposite surface 111 of the driver circuit element 109. In some embodiments, the plurality of grooves 127 houses the plurality of conducting clips 122. The grooves 127 may hold the conducting clips 122 in place, ensuring that the ends of the conducting clips 122 contact electrodes 112, 113 on the light-emitting element 101 and the driver circuit element 109. The holder 123 may also include at least one slot 128 in the third portion 126 of the holder 123; the base plate 104 may also include at least one wing 114 that extends through the at least one slot 128 and beyond the third portion 128 of the holder 123. In some embodiments, this ensures that the at least one wing 114 can contact the heat sink 110; for instance, the heat sink 110 may form a housing having an interior surface, with at least one shelf 120 on the interior surface, such that the at least one wing 114 that extends through the at least one slot 128 rests on the at least one shelf 120.

Figure 2A:
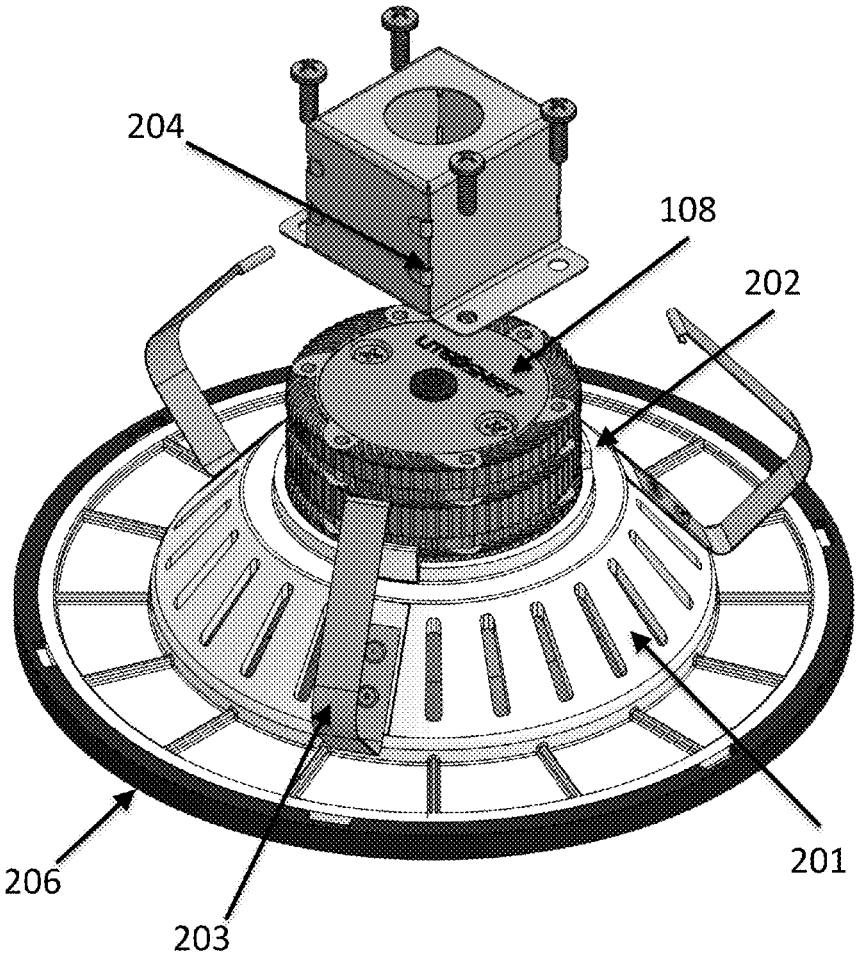
FIG. 2A is a schematic diagram of one embodiment of a light fixture.

In some embodiments, as shown in FIG. 2A, the light-emitting device 100 and heat sink 108 are attached to a light fixture 200. In one embodiment, the light fixture 200 is a structure that allows the light-emitting device 100 and heat sink 108 to be installed on a structure such as a room interior, wall, ceiling, or floor. The light fixture 200 may have a body 201. The body 201 may be constructed using any suitable material or combination of materials. The body 201 may be constructed using metal. The body 201 may be constructed using a natural polymer. The body 201 may be constructed using a synthetic polymer, such as plastic. The body 201 may be constructed using plastic. The body 201 may be constructed using resin. The body 201 may be constructed using wood. The body 201 may be constructed using fiberglass. In some embodiments, the body 201 is constructed using ceramic. In some embodiments, the body 201 is constructed using glass. The body 201 may be attached to the housing 110 using one or more fasteners 202. The fasteners 202 may be slot- and tab fasteners. The fasteners 202 may be screws.

Some embodiments of the light fixture 200 are adapted for insertion into a recess in a substantially planar structure. A recess may be a hole in a sheet of material such as a drop ceiling panel or sheet rock. The recess may have an opening. The opening may be polygonal; for instance, the opening may be rectangular. The opening may be curved; as an example, the opening may be circular. The opening may be elliptical. In some embodiments, the light fixture 200 has features that hold it in place within the recess. In one embodiment, the fixture 200 includes a plurality of spring clips 203. The spring clips 203 may be attached to the body 201. In some embodiments, the locations of attachment of the spring clips 203 on the body are such that when the body is correctly placed within the recess, the locations are at the edges of the opening. For instance, the plurality of spring clips 203 may be fixed to the body 201 of a fixture 200 designed to fit in a recess with a circular opening at locations just within the circumference of a circle the size of the recess around the geometric center of the horizontal cross-section of the fixture. In some embodiments, the spring clips protrude from the body 201 in the direction of the edges of the recess, such that when the body 201 with the spring clips 203 attached is inserted in the recess, the spring recoil force of the spring clips 203 causes them to push against the sides of the recess, holding the fixture 200 in place within the recess. The spring clips 203 may also be bent such that they angle back toward the center of the recess; this may cause the edges of the recess to push the spring clips 203 toward the center of the recess when the fixture 200 is inserted into the recess, facilitating insertion and introducing a bias in the spring clips toward the edges of the recess. The ends of the spring clips 203 may be rounded; for instance, the ends of the spring clips may be bent into a tight, substantially cylindrical roll. The fixture 200 may include an element, such as an Edison screw, for mounting the fixture into an existing light socket.

Figure 2B:
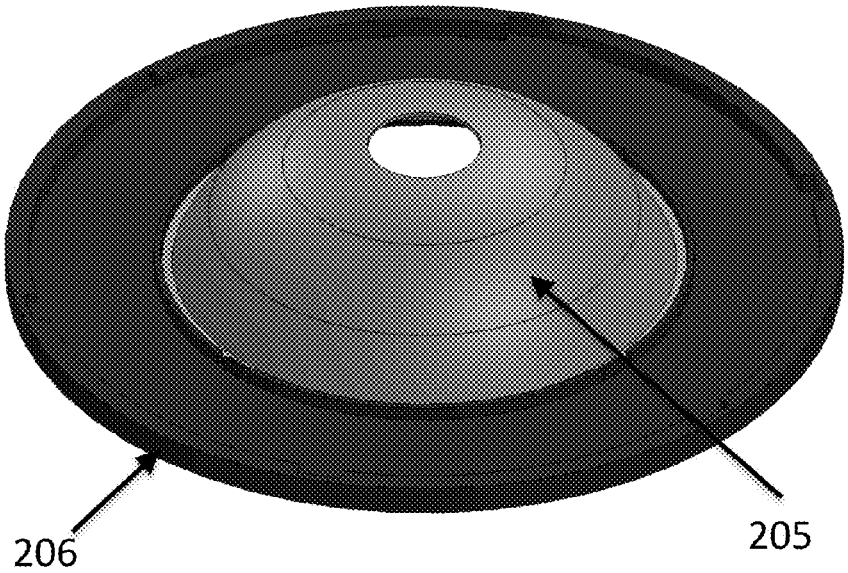
FIG. 2B is a schematic diagram of one embodiment of a reflecting mirror to be combined with a light fixture and an embodiment of the disclosed device.

Some embodiments of the fixture 200 include other features. The fixture 200 may include a conduit box 204 for attachment of electrically conducting cables to the light-emitting device 100. As shown in FIG. 2B, the fixture 200 may include a reflector 205. The reflector 205 may be shaped to redirect the light emitted by the light-emitting device 100. The reflector 205 may be hemispherical. The reflector 205 may be parabolic. In some embodiments, the reflector 205 is attached to the fixture 200 using one or more fasteners. In other embodiments, the reflector 205 is attached to the fixture 200 using one or more screws. The reflector may be fused to the fixture 200. The reflector may be attached to the fixture 200 by adhesive. In additional embodiments, a cap 206 holds the reflector in place in the fixture 200. The cap 206 may be attached to the fixture 200 by any of the above-described methods. The cap 206 may be attached to the fixture 200 via a slot- and tab assembly; for instance, the fixture 200 may have grooves into which tabs on the cap 206 may be inserted by rotating the cap. The reflector 205 may be attached to the housing 108 or the light-emitting device 100 by any of the above-described methods.

Figure 3:
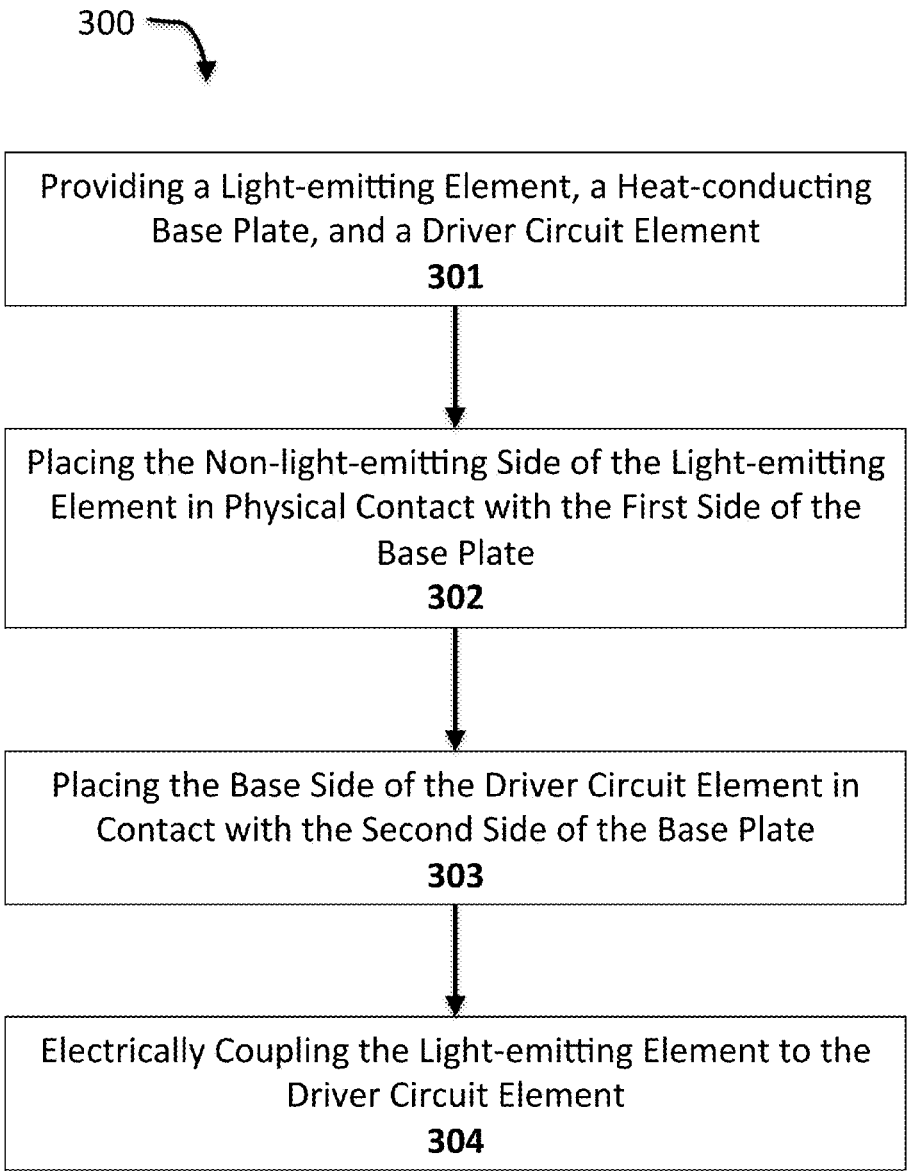
FIG. 3 is a flow diagram illustrating one embodiment of the disclosed method.

FIG. 3 is a flow chart illustrating one embodiment of the disclosed method 300 for assembling a heat-dissipating, light-emitting device. As a brief overview, the method 300 includes providing a light-emitting element, a heat-conducting base plate, and a driver circuit element, as described above in reference to FIGS. 1A-1D (301). The method 300 includes placing the non-light-emitting side of the light-emitting element in physical contact with the first side of the base plate (302). The method 300 includes placing the base side of the driver circuit element in contact with the second side of the base plate (303). The method 300 includes electrically coupling the light-emitting element to the driver circuit element (300).

In further detail, and as further illustrated by 1A-1E, the method 300 involves providing a light-emitting element, a heat-conducting base plate, and a driver circuit element, as described above in reference to FIGS. 1A-1E (301). The light-emitting element 101 may have any feature described above for a light-emitting element 101 in reference to FIGS. 1A-1E. The base plate may have any feature described above for a base plate 104 in reference to FIGS. 1A-1E. The driver circuit element 109 may have any feature described above for a driver circuit element 109 in reference to FIGS. 1A-1E. The features of the three parts provided may be complementary; for instance, the base plate 104 may have a cavity in its first surface 105 in which the light-emitting element 101 may fit snugly.

The method 300 includes placing the non-light-emitting side of the light-emitting element in physical contact with the first side of the base plate (302). Where the base plate 104 has a cavity 115 on its first surface 105, placing the non-light-emitting side of the light-emitting element in physical contact with the first side of the base plate may involve placing the light-emitting element 101 within that cavity. The light-emitting element 101 may be attached to the base plate 104 using any means described above in reference to FIGS. 1A-1C. The light-emitting element 101 may be placed on the base plate 104 so that the light-emitting element 101 is electrically isolated from the base plate 104.

The method 300 includes placing the base side of the driver circuit element in contact with the second side of the base plate (303). Where the base plate 104 has a cavity 115 on its second surface 106, placing the base side 110 of the driver circuit element 109 in physical contact with the second side 106 of the base plate 104 may involve placing the driver circuit element 104 within that cavity. The driver circuit element 109 may be attached to the base plate 104 using any means described above in reference to FIGS. 1A-1C. The driver circuit element 109 may be placed on the base plate 104 so that the driver circuit element 109 is electrically isolated from the base plate 104.

The method 300 includes electrically coupling the light-emitting element to the driver circuit element (300). The light emitting element 101 may be coupled to the driver circuit element 109 using any means for accomplishing that coupling as described above in reference to FIGS. 1A-1C. In some embodiments, the light-emitting element 101 is coupled to the driver circuit element 109 using a plurality of conducting clips 122. In some embodiments, the light-emitting element 101, base plate 104, and driver circuit element 109 are held together by an electrically insulating holder 123; for instance, the method 300 may further include assembling a plurality of sections to form the holder 123 around the light-emitting element 101, base plate 104, and driver circuit element 109, so that the holder 123 holds the light-emitting element 101, base plate 104, and driver circuit element 109 together. The conducting clips 122 may be placed within grooves 127 in the holder 123, as described above in reference to FIGS. 1A-1D. The method 300 may further involve placing the base plate 104 in contact with a heat sink 108. Where the heat sink 108 is a housing as described above in reference to FIGS. 1A-1C, placing the base plate 104 in contact with the heat sink 108 may involve inserting the base plate 104 into the housing. Further embodiments of the method 300 also involve attaching the light-emitting device 100 and heat sink 108 to a light fixture 200, as described above in reference to FIGS. 2A and 2B.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A heat-dissipating light-emitting device, the device comprising:

a light-emitting element having a light-emitting surface and a non-light-emitting surface;

a thermally conducting base plate having a first surface against which the light-emitting element is placed, a second surface, and a perimeter surface, the thermally conducting base plate electrically isolated from the light-emitting element, the thermally conducting base plate in physical contact with a heat sink, the heat sink further comprising a housing having an open end, such that the light-emitting device fits snugly in the housing with the light-emitting surface facing the open end; and a driver circuit element having a base surface in contact with the second surface of the base plate, and an opposite surface, the driver circuit element electrically coupled to the light-emitting element, the driver circuit electrically isolated from the base plate.

2. A device according to claim 1, wherein the base plate further comprises at least one wing that contacts the heat sink.

3. A device according to claim 1, wherein the base plate further comprises a cavity in the first surface shaped to admit the non-light-emitting surface of light-emitting element.

4. A device according to claim 1, wherein the base plate further comprises a cavity in the second surface shaped to admit the base surface of the driver circuit element.

5. A light-emitting device according to claim 1, wherein the heat sink further comprises at least one heat-dissipating fin.

6. A device according to claim 1, wherein the driver circuit element further comprises at least one rectifier.

7. A heat-dissipating light-emitting device, the device comprising:

a light-emitting element having a light-emitting surface and a non-light-emitting surface;

a thermally conducting base plate having a first surface against which the light-emitting element is placed, a second surface, and a perimeter surface, the thermally conducting base plate electrically isolated from the light-emitting element, the thermally conducting base plate in physical contact with a heat sink; and a driver circuit element having a base surface in contact with the second surface of the base plate, and an opposite surface, the driver circuit element electrically coupled to the light-emitting element by a plurality of conducting clips that connect contact points in the light-emitting element to contact points in the driving circuit, the driver circuit electrically isolated from the base plate.

8. A device according to claim 7, wherein the conducting clips are shaped to pass from the first surface of the base plate to the second surface of the base plate without touching the base plate.

9. A device according to claim 7, further comprising an electrically insulating holder having:

a first member that extends over a portion of the light-emitting surface of the light-emitting element;

a second member that extends over a portion of the opposite surface of the driver circuit element; and a third member that connects the first member to the second member across the peripheral surface of the base plate.

10. A device according to claim 9, wherein the holder further comprises a plurality of grooves, each groove containing one of the plurality of conducting clips, each groove running from a first end at an electrical contact on the light-emitting surface of the light-emitting element, across the first member of the holder, across the third member of the holder, across the second member of the holder, and to a second end at an electrical contact on the opposite surface of the driver circuit element.

11. A device according to claim 9, wherein the holder further comprises a plurality of detachable sections.

12. A device according to claim 9, wherein the holder further comprises at least one slot in the third portion of the holder, and wherein the base plate further comprises at least one wing that extends through the at least one slot and beyond the third portion of the holder.

13. A device according to claim 12, wherein the heat sink further comprises a housing having an interior surface, the housing further comprising at least one shelf on the interior surface, such that the at least one wing that extends through the at least one slot rests on the at least one shelf.

14. A device according to claim 9, wherein the portion of the light-emitting surface covered by the first portion does not emit light.

15. A device according to claim 1, wherein the device is attached to a light fixture adapted for insertion into a recess.

16. A method for assembling a heat-dissipating, light-emitting device, the device comprising a light-emitting element having a light-emitting surface and a non-light-emitting surface, a thermally conducting base plate having a first surface against which the light-emitting element is placed, a second surface, and a perimeter surface, the thermally conducting base plate electrically isolated from the light-emitting element, the thermally conducting base plate in physical contact with a heat sink, and a driver circuit element having a base surface in contact with the second surface of the base plate, and an opposite surface, the driver circuit element electrically coupled to the light-emitting element, the driver circuit electrically isolated from the base plate, the method comprising:

providing a light-emitting element having a light-emitting surface and a non-light-emitting surface, a heat-conducting base plate having a first surface, a second surface, and a perimeter surface, and a driver circuit element having a base surface and an opposite surface, and a heat sink;

placing the non-light-emitting side of the light-emitting element in physical contact with the first side of the base plate so that the light emitting element is electrically isolated from the base plate;

placing the base side of the driver circuit element in contact with the second side of the base plate so that the driver circuit element is electrically isolated from the base plate;

electrically coupling the light-emitting element to the driver circuit elements while keeping the light-emitting element and the driver circuit element electrically isolated from the base plate; and placing the thermally conducting base plate in contact with the heat sink.

* * * * *